United States Patent [19]

Besemann

[11] Patent Number: 4,765,790

[45] Date of Patent: Aug. 23, 1988

[54] APPARATUS FOR ACCUMULATING STACKS OF PAPER SHEETS AND THE LIKE

[75] Inventor: Alfred Besemann, Hamburg, Fed. Rep. of Germany

[73] Assignee: E.C.H. Will (GmbH & Co.), Hamburg, Fed. Rep. of Germany

[21] Appl. No.: 44,959

[22] Filed: Apr. 30, 1987

[30] Foreign Application Priority Data

May 2, 1986 [DE] Fed. Rep. of Germany ..... 3614884

[51] Int. Cl.[4] ..... B65H 31/30

[52] U.S. Cl. ..... 414/47; 414/43; 414/50; 414/903

[58] Field of Search ..... 414/43, 47, 50, 98, 414/903; 271/218

[56] References Cited

U.S. PATENT DOCUMENTS

| | | | |
|---|---|---|---|
| 2,849,236 | 8/1958 | Beaulieu | 414/47 X |
| 2,940,616 | 6/1960 | Reed | 414/903 X |
| 3,025,057 | 3/1962 | Dale et al. | 271/218 |
| 3,131,819 | 5/1964 | Ducayet | 414/47 |
| 3,150,786 | 9/1964 | Pratt | 414/43 X |
| 4,111,411 | 9/1978 | Graves et al. | 414/50 X |
| 4,297,066 | 10/1981 | Ramcke et al. | 414/43 |
| 4,359,218 | 11/1982 | Karis | 414/50 X |
| 4,436,472 | 3/1984 | Kunzmann | 414/50 |
| 4,474,093 | 10/1984 | Neubüser et al. | 414/43 X |
| 4,599,039 | 7/1986 | Neubüser et al. | 414/786 |

FOREIGN PATENT DOCUMENTS

| | | | |
|---|---|---|---|
| 115604 | 8/1965 | Denmark | 414/43 |

*Primary Examiner*—Leslie J. Paperner

*Attorney, Agent, or Firm*—Peter K. Kontler

[57] ABSTRACT

Apparatus for converting a continuous stream of partially overlapping sheets of paper or the like into a succession of stacks has a table which is movable between a first position adjacent the discharge end of a conveyor for the stream of sheets and a second position adjacent a stack removing unit. When in first position, the table is lowered gradually at the rate at which the height of the growing stack on its top increases, and such table is mounted on a reciprocable carriage which further supports a platform adjacent to the table so that the platform can enter the gathering station and take over a growing stack while the fully grown stack on the table is advanced to the removing unit. The table and the platform are provided with conveyors so that a fully grown stack can be transferred from the table onto the removing unit and the conveyor on the platform can transfer a growing stack onto the table when the transfer of the fully grown stack onto the stack removing unit is completed.

14 Claims, 5 Drawing Sheets

APPARATUS FOR ACCUMULATING STACKS OF PAPER SHEETS AND THE LIKE

BACKGROUND OF THE INVENTION

The invention relates to apparatus for accumulating stacks of paper sheets and the like. More particularly, the invention relates to improvements in apparatus for accumulating stacks from sheets which are made of paper, plastic material, metallic foil, cardboard or the like and wherein a stream of advancing sheets is continuously converted into a succession of stacks, especially stacks which are assembled of large sheets.

It is known to convert a continuous stream of successive non-overlapping or partially overlapping sheets of paper or the like into a succession of stacks each of which contains a predetermined number of fully overlapping sheets. Such apparatus can be used in a production line for the making of exercise books, steno pads and similar stationery products. As a rule, the stacks are accumulated on a table which is movable between a stack accumulating or collecting position and a second position preparatory to transfer of a fully grown stack to a removing device, such as a set of belt conveyors. The table is movable from a higher level to a plurality of lower levels at the rate at which the height of the growing stack thereon increases. The sheets which are delivered while the table transfers a fully grown stack to the removing device are gathered by a carrier so as to avoid the need for a stoppage of the delivery of sheets to the stacking or gathering station. The sheets can be advanced from a cross cutter which severs a single running web of paper or other sheet material at regular intervals or which is designed to sever at regular intervals two or more overlapping webs of sheet material so that the overlapping webs are converted into a succession of composite sheets each of which comprises two or more individual or discrete sheets, depending upon the number of overlapping webs.

It is desirable and advantageous to transport a fully grown stack on the table away from the gathering station in such a way that the next-following sheets are not damaged during accumulation into a pile of overlapping sheets preparatory to their transfer onto the evacuated table as well as that the delivery of sheets can proceed without any interruptions. The sheets are most likely to be defaced and/or otherwise damaged at the top of the fully grown stack as well as the bottom of a growing stack.

Apparatus of the above outlined character are known and are in actual use in a variety of forms. Reference may be had, for example, to British Pat. No. 929,540 which discloses a vertically adjustable table for accumulation of a growing stack. The table is lowered at the rate at which the stack thereon grows so as to ensure that the top of the growing stack is in an optimum position for reception of the oncoming sheet. When the table accumulates a preselected number of sheets, a separating device is caused to enter the gathering station and to intercept the next-following sheets as well as to support the intercepted sheets during transfer of the fully grown stack onto the removing device. Such transfer takes place by moving the entire table from its operative position at the gathering station to a second position in which the fully grown stack thereon is transferred onto the removing device. The patent proposes to employ a supporting strap which is caused to extend beneath the gathering station while the table and the fully grown stack on it are being transferred to the removing device In other words, the strap constitutes a temporary support or carrier for the growing stack. A drawback of such proposal is that the supporting surface of the strap is not overly stable because its stability depends upon the tensioning of the strap and on the weight of the sheets thereon. This can entail undesirable changes in the configuration of the growing stack so that the fully grown stack cannot be properly manipulated in the next-following treating unit, such as a packing machine. Moreover, all movements between the table and the stacks as well as between neighboring (fully grown and growing) stacks are affected by friction.

OBJECTS AND SUMMARY OF THE INVENTION

An object of the invention is to provide an apparatus wherein the sheets and the growing and fully grown stacks are manipulated in such a way that their appearance and/or other desirable characteristics are not affected by friction.

Another object of the invention is to provide an apparatus wherein successive stacks can be accumulated at a very high frequency and without affecting their appearance and/or the condition of their sheets.

A further object of the invention is to provide the apparatus with novel and improved means for supporting a growing stack of sheets during transfer of a fully grown stack from the gathering station to the removing device.

Still another object of the invention is to provide the apparatus with novel and improved means for transporting the stacking or gathering table to and from its operative position.

A further object of the invention is to provide the apparatus with novel and improved means for intercepting oncoming sheets upon completion of accumulation of a predetermined number of preceding sheets into a fully grown stack.

A further object of the invention is to provide novel and improved means for reducing or eliminating friction between a fully grown stack and a growing stack.

An additional object of the invention is to provide the apparatus with novel and improved means for ensuring the accumulation of successive sheets into stacks wherein the sheets accurately overlap each other.

An additional object of the invention is to provide a novel and improved method of continuously converting a succession of partially overlapping or non-overlapping sheets into a series of stacks.

Another object of the invention is to provide a method which can be carried out in such a way that the sheets of the stacks are not damaged and the stacks are not deformed during accumulation of stacks into sheets as well as during subsequent manipulation of fully grown stacks.

The invention is embodied in an apparatus for forming and removing stacks of superimposed sheets, especially large sheets which consist of paper or other suitable material. The apparatus comprises mean for transporting a series of successive sheets along a predetermined path in which the sheets may but need not partially overlap each other, a stacking or gathering table which is movable between a first position adjacent a predetermined portion of the path to accumulate successive sheets of the series into a growing stack and a second position for removal of the fully grown stack from it, a platform which is movable between a first position of readiness and a second position adjacent the predetermined portion of the path to collect successive sheets of the series while the table is out of the first position, and means for jointly moving the table and the platform so that the table assumes its first position while the platform assumes its first position and the table assumes its second position while the platform assumes its second position.

The apparatus preferably further comprises means for moving the table up and down at least while in the first position, and means for moving the platform up and down, at least while in the second position.

The means for jointly moving the table and the platform preferably comprises a common carriage for the table and the platform and means for moving the carriage from a first position (in which the table and the platform assume their first positions) to a second position in which the table and the platform assume their second positions, and back to the first position.

The means for moving the table and the platform up and down are preferably operable to move the table up and down relative to the platform and vice versa. In other words, each such moving means is operable independently of the other.

The table preferably comprises a support and a conveyor which is movably mounted on the support and serves to gather oncoming sheets into a growing stack in the first position of the table. Such conveyor can include an endless belt conveyor. Analogously, the platform can include a support and a conveyor which is movably mounted on the support and serves to gather oncoming sheets into a growing stack in the second position of the platform. The conveyor of the platform can also constitute an endless belt conveyor.

The predetermined portion of the path can constitute the discharge end of the path.

The apparatus preferably further comprises means for biasing the sheets of a fully grown stack against the table, at least during a portion of movement of the table from the first to the second position. Such biasing means and the table can cooperate not unlike the jaws of tongs to releasably clamp a fully grown stack between them.

Still further, the apparatus preferably comprises means for intercepting oncoming sheets in the predetermined portion of the path during movement of the table and platform from their first to their second positions. Such intercepting means can include a finger and means for moving the finger between the topmost sheet of a fully grown stack on the table in the first position of the table and the oncoming sheet of the series of sheets in the path. The finger can be provided with at least one orifice, and the apparatus preferably further comprises means for admitting into the orifice a compressed gaseous fluid to establish a cushion of gaseous fluid between the topmost sheet of the fully grown stack on the table and the next-following sheet of the series of sheets. The arrangement is preferably such that the means for jointly moving the table and the platform includes means for moving the table from the first position only when the intercepting means has already intercepted a preselected number of sheets.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
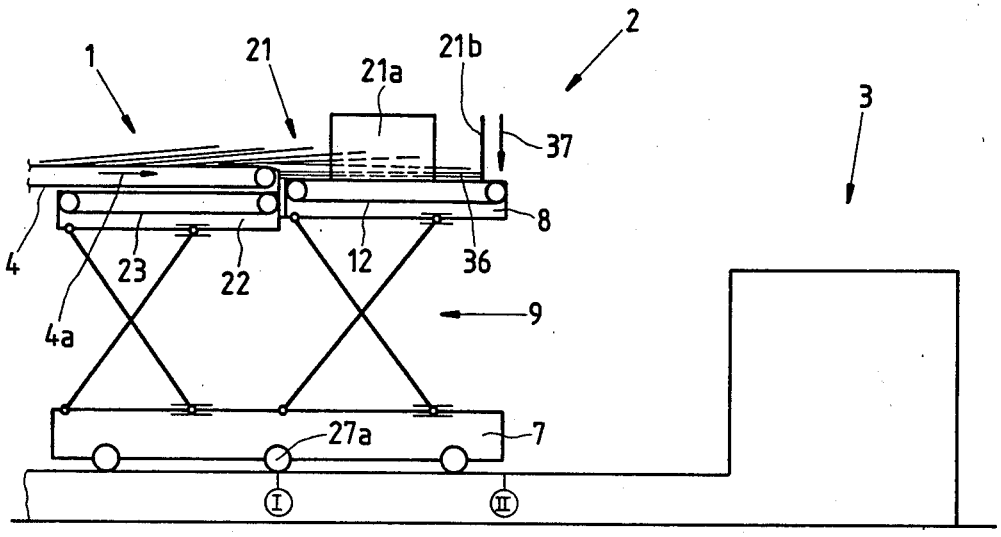
FIG. 1 is a schematic elevational view of an apparatus which embodies one form of the invention and wherein the table is shown during the initial stage of accumulation of a first stack on its conveyor.

The invention will be described first with reference to FIG. 3 which shows all necessary details of the improved apparatus. The apparatus comprises a transporting unit 1 which serves to deliver a scalloped stream of partially overlapping sheets or groups of sheets 6 in the direction of arrow 4*a* along a substantially horizontal path to a stacking or gathering station 2. The apparatus further comprises a removing unit 3 which serves to receive fully grown stacks 36 for transport to a further processing station, for example, toward or directly to a packing machine. The transporting unit 1 comprises an endless belt conveyor 4 which can include a single relatively wide belt or a plurality of relatively narrow belts mounted in parallel vertical planes in a manner well known from the art of transporting paper sheets and the like. If the transporting unit 1 comprises several endless belt conveyors, such belt conveyors are driven in synchronism so that their upper reaches transport the stream of partially overlapping sheets 6 in the direction of arrow 4*a* without any shifting of sheets relative to each other. The transporting unit 1 receives sheets 6 from a cross cutter, not shown, which can subdivide a single web of paper or the like to form a succession of discrete sheets 6, or which can cut across two or more overlapping webs of paper or the like so that each sheet 6 constitutes a group of two or more fully overlapping individual sheets.

The stacking or gathering station 2 occupies a predetermined portion of the path which is defined by the transporting unit 1, namely the discharge end of such path. The apparatus further comprises a table 8 which is movable between a first position at the gathering station 2 immediately beneath the oncoming sheets 6 and a second position adjacent the removing unit 3. The table 8 is mounted on a means 9 for moving it up and down, i.e., toward and away from the path of oncoming sheets 6. The moving means 9 is of conventional design and includes a shear-like device having two legs 9a, 9b the first end portions of which are articulately connected to the upper side of a carriage 7 and to the underside of the table 8, as at 9c, and the second end portions of which are slidably guided in tracks 9d provided at the underside of the table 8 and at the upper side of the carriage 7, respectively. A motor 11 of the moving means 9 is mounted on the carriage 7 to change the inclination of the legs 9a, 9b relative to each other and to thereby move the table 8 downwardly toward or upwardly away from the carriage. The motor 11 can constitute a hydraulic or pneumatic double-acting cylinder and piston unit.

Figure 3:
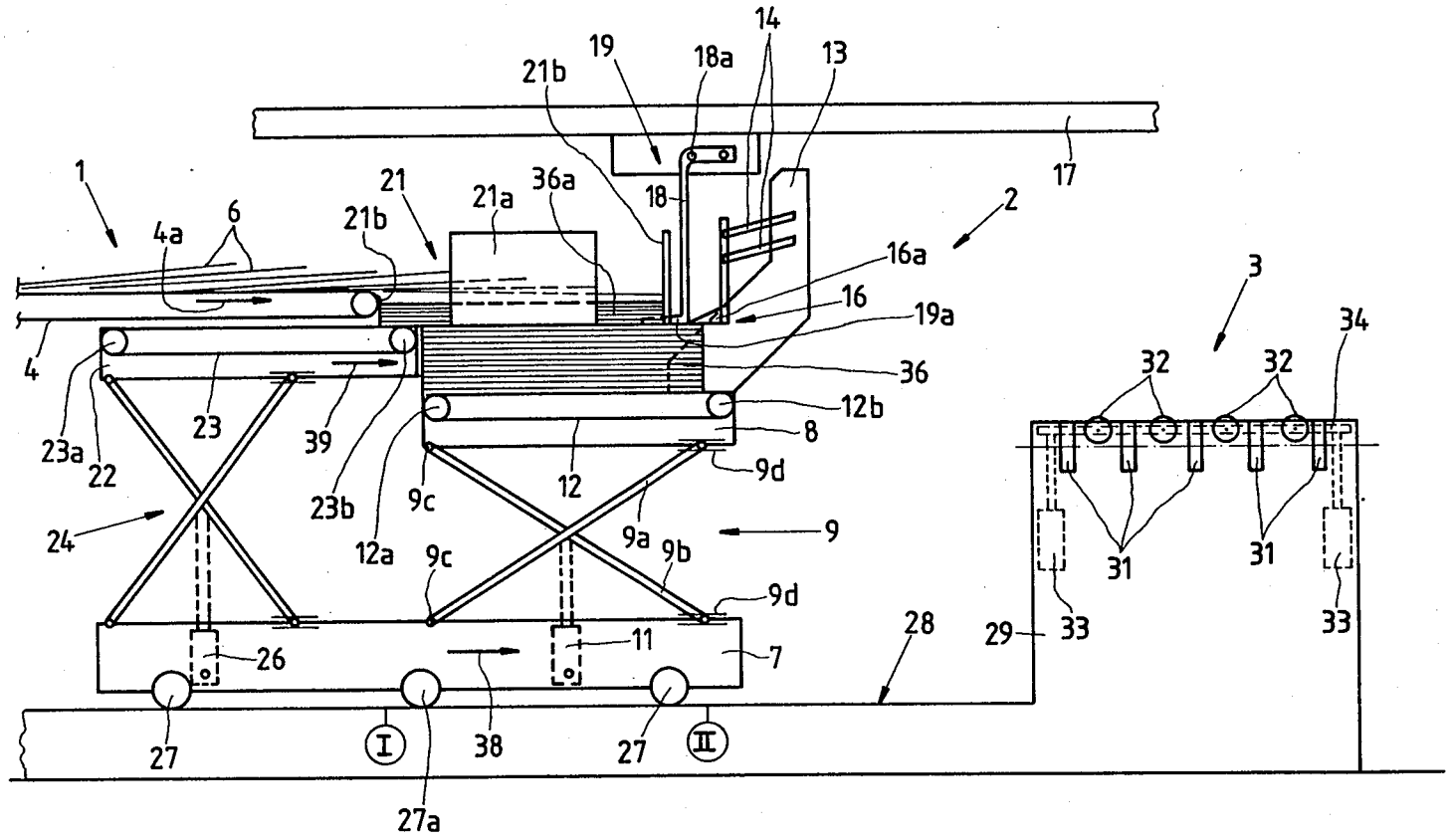
FIG. 3 is an enlarged elevational view of the apparatus and shows the intercepting means in operation upon completed accumulation of a stack on the table.

The table 8 comprises a horizontal base or support and an endless belt conveyor 12 which is disposed above the support and is trained over pulleys 12a, 12b so that its upper reach is located beneath the gathering station 2 when the table 8 assumes the first position which is shown in FIG. 3. The conveyor 12 can constitute a relatively wide endless apron or it can be composed of several narrow belts which are disposed in parallel vertical planes. The motor which drives the conveyor 12 of the table 8 during certain stages of operation of the apparatus is not specifically shown. For example, such motor can constitute an electric motor which is mounted on the support of the table 8 and drives one of the pulleys 12a, 12b.

The table 8 supports lateral brackets 13 for the links of a parallel motion 14 which carries a gripping or clamping device 16 including one or more rams 16a adapted to engage the topmost sheet of a fully grown stack 36 on the upper reach of the conveyor 12 so as to ensure that such stack is held against movement relative to the conveyor 12. The ram or rams 16a cooperate with the upper reach of the conveyor 12 not unlike the jaws of tongs to temporarily grip the fully grown stack 36 from above and from below. The tongs serves to extract the fully grown stack 36 from the gathering station 2 without permitting any shifting of the fully overlapping sheets 6 in the fully grown stack 36 relative to each other.

FIG. 3 further shows a portion of the machine frame 17 which carries an intercepting device 19 including a bell crank lever 18 pivotable at 18a and having a finger 19a which serves to penetrate between the topmost sheet of the fully grown stack 36 on the conveyor 12 of the table 8 and the next-following (oncoming) sheet 6 which is delivered by the conveyor 4 of the transporting unit 1. A housing beneath the frame 17 contains or carries a motor (not shown) which can pivot the bell crank lever 18 of the intercepting device 19 to and from the operative position which is shown in FIG. 3 and in which the finger 19a overlies the topmost sheet of the fully grown stack 36 and is located beneath the next-following sheet. The next-following sheet constitutes the lowermost sheet of a growing stack 36a. The finger 19a of the bell crank lever 18 actually extends into a receptacle 21 which is formed by two lateral stops or abutments 21a (only one can be seen in FIG. 3) and by two end stops 21b. The stops 21a and 21b define a compartment which ensures that each oncoming sheet 6 is arrested in a predetermined position of exact register with the preceding sheet so that each growing stack can be assembled of sheets which are accumulated in a predictable fashion.

In accordance with a feature of the invention, the apparatus further comprises a second table 22 (hereinafter called platform in order to distinguish from the table 8) which also comprises a base or support and an endless belt conveyor 23 trained over pulleys 23a and 23b in a manner analogous to that of the conveyor 12 of the table 8. The means 24 for moving the support of the platform 22 at up and down is constructed in the same way as the moving means 9 for the support of the table 8. The motor which can pivot the legs of the moving means 24 relative to each other in order to move the support of the platform toward or away from the upper side of the carriage 7 is shown at 26. The conveyor 23 can comprise a single relatively wide apron or a set of narrow endless belts which are disposed in parallel vertical planes.

The carriage 7 is provided with rollers or wheels 27 which can travel along a horizontal track 28 between a first position I and a second position II. The reference characters I and II denote the positions of an intermediate roller or wheel 27 on the carriage 7 in the respective positions of the carriage. When the carriage 7 assumes its first position, the table 8 and the platform 22 are maintained in their first positions which are shown in FIG. 3. When the carriage 7 is moved in the direction of arrow 38 to assume its second position, the table 8 assumes a second position adjacent the stack removing unit 3, and the platform 22 assumes a second position adjacent the predetermined portion of the path which is defined by the transporting unit 1, namely at the stacking or gathering station 2. The carriage 7 can be shifted by hand or by one or more motors which are not specifically shown in the drawing. For example, a reversible electric motor can be mounted in the carriage 7 to rotate one of the wheels 27 or the intermediate wheel 27a.

The stack removing unit 3 comprises a frame 29 for a set of five parallel endless belt conveyors 31 which are disposed in parallel vertical planes extending at right angles to the plane of FIG. 3, i.e., at right angles to the longitudinal direction of the path which is defined by the transporting unit 1. In the region where the extension of the path intersects the composite conveyor including the five endless belt conveyors 31 of the stack removing unit 3, the frame 29 supports a skeleton frame 34 for one or more rows of rollers 32. The skeleton frame 34 is movable up and down by two motors 33 which are mounted in the frame 29. When the motors 33 are caused to lift the skeleton frame 34, portions of the rollers 32 extend to a level above the upper reaches of the belt conveyors 31. The construction of the stack removing unit 3 is known and need not be described in detail.

The arrow 39 denotes in FIG. 3 the direction in which the platform 22 moves with the table 8 when the carriage 7 is caused to move in the direction of arrow 38.

The mode of operation of the apparatus which is shown in FIG. 3 will be described with reference to FIGS. 1, 2 and 4–8. The reference characters which are used in FIGS. 1, 2 and 4–8 correspond to those which are employed in FIG. 3. The conveyor 4 of the transporting unit 1 advances the scalloped stream of sheets in the direction of arrow 4a (FIG. 1) so that successive sheets of the series of sheets forming the stream reach the gathering station 2. Such sheets are oriented by the stops 21a and 21b of the receptacle 21 so that they descend upon the upper reach of the conveyor 12 of the table 8 in a predictable manner to form a growing stack.

At such time, the motors which are mounted in the supports of the table 8 and platform 22 maintain the respective conveyors 12 and 23 at a standstill. The carriage 7 is held in the position I, i.e., the table 8 and the platform 22 are kept in their first positions in which the table 8 is located beneath the gathering station 2 and is remote from the stack removing unit 3 and the platform 22 is maintained in a (first) position of readiness beneath the conveyor 4 of the transporting unit 1 to the left of the gathering station 2. The moving means 9 is actuated at required intervals or continuously so as to intermittently or continuously lower the table 8 at the rate at which the height of the stack 36 on the upper reach of the conveyor 12 grows in response to reception of additional sheets. The direction of downward movement of the table 8 is indicated in FIG. 1 by an arrow 37. At such time, the platform 22 is maintained in or close to its upper end position beneath the lower reach of the conveyor 4. As mentioned above, this is a first position (position of readiness) of the platform 22.

When the stack on the conveyor 12 of the table 8 is converted into a fully grown stack 36 which contains a predetermined number of accurately overlapping sheets, the finger 19*a* of the intercepting device 19 is pivoted by the bell crank lever 18 so as to penetrate into the space above the topmost sheet of the fully grown stack 36 and the oncoming sheet. This can be seen in FIG. 2. The finger 19*a* actually enters a gap in the adjacent end stop 21*b* of the receptacle 21 so as to support the lowermost sheet of the next (growing) stack 36*a* from below. The moving means 9 then lowers the table 8 to such an extent that the upper side of the topmost sheet of the fully grown stack 36 is flush with the upper side of the upper reach of the conveyor 23 forming part of the platform 22. This can be seen in FIG. 3.

In the next step, the carriage 7 is moved from the position I to the position II so that the table 8 advances from the first to the second position (shown in FIG. 4) and the platform 22 advances from the first position (of readiness) to the second position at the gathering station 2. The direction of such movement of the carriage 7 together with the platform 22 and table 8 is indicated by the arrow 38 (see FIG. 3). At the same time, the conveyor 23 of the platform 22 is set in motion in the direction of arrow 39 (see FIG. 3) so that the upper reach of the conveyor 23 advances beneath the lowermost sheet 6 of the growing stack 36*a* in the receptacle 21 without any friction between such conveyor and the lowermost sheet.

Figure 2:
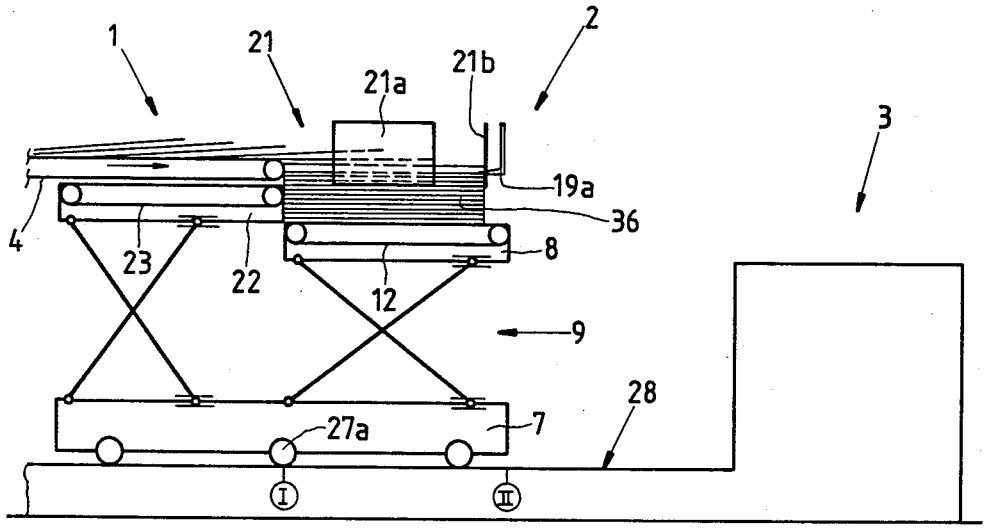
FIG. 2 shows the structure of FIG. 1 with the table in a position it assumes during the last stage of accumulation of a stack.
Figure 4:
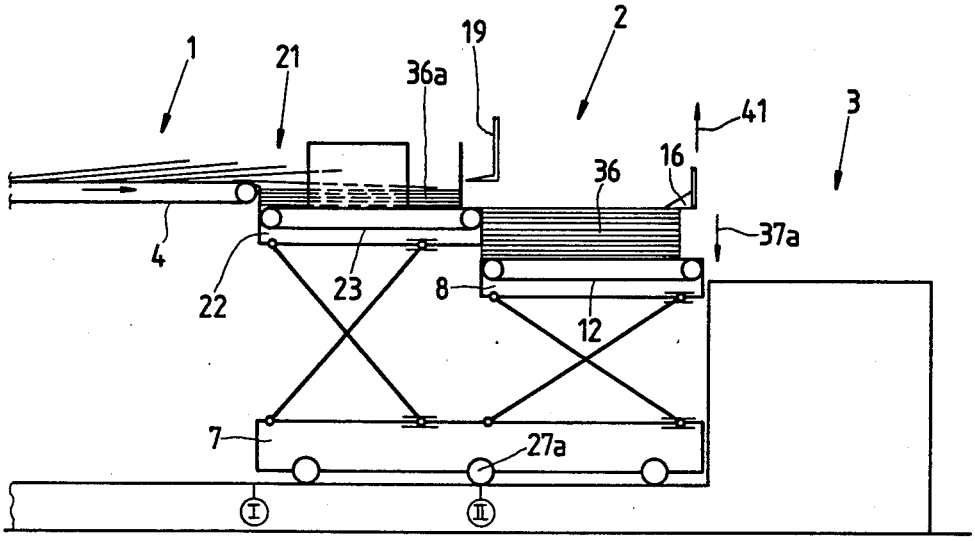
FIG. 4 shows the structure of FIGS. 1-2, with the table and platform in their second positions.

The aforementioned drive for the ram or rams 16*a* causes the ram or rams to descend upon the topmost sheet of the fully grown stack 36 on the conveyor 12 so that the ram or rams cooperate with the conveyor 12 to act not unlike tongs and to grip the fully grown stack 36 in order to prevent any shifting of its sheets 6 during transfer from the first position of FIG. 2 to the second position of FIG. 4. The ram or rams 16*a* further cooperate with the conveyor 12 to prevent any distortion of the fully grown stack 36, i.e., the sheets of such fully grown stack remain in positions of accurate and full overlap with each other.

It is preferred to extract the fully grown stack 36 from the gathering station 2 only when the growing stack 36*a* in the receptacle 21 already contains a preselected number of sheets, i.e., when the height of the sheets of such stack by reducing the likelihood of deformation of lowermost sheets during extraction of the fully grown stack 36 from the station 2.

When the carriage 7 reaches the position II of FIG. 4, the conveyor 23 of the platform 22 is arrested and the finger or fingers 19*a* of the intercepting device 19 are extracted from the gap between the topmost sheet of the fully grown stack 36 and the lowermost sheet of the growing stack 36*a* so that the growing stack 36*a* can descend in the receptacle 21 onto the upper reach of the conveyor 23 forming part of the platform 22. At the same time, the moving means 9 causes the table 8 to descend again in the direction of arrow 37*a* until the lowermost sheet of the stack 36 reaches the level of the apices of the rollers 32 on the skeleton frame 34 in the stack removing unit 3. At the same time, the ram or rams 16*a* are lifted in the direction of arrow 41 (FIG. 4) so that the clamping action upon the topmost sheet of the fully grown stack 36 is terminated and the fully grown stack merely rests on the upper reach of the conveyor 12.

Figure 5:
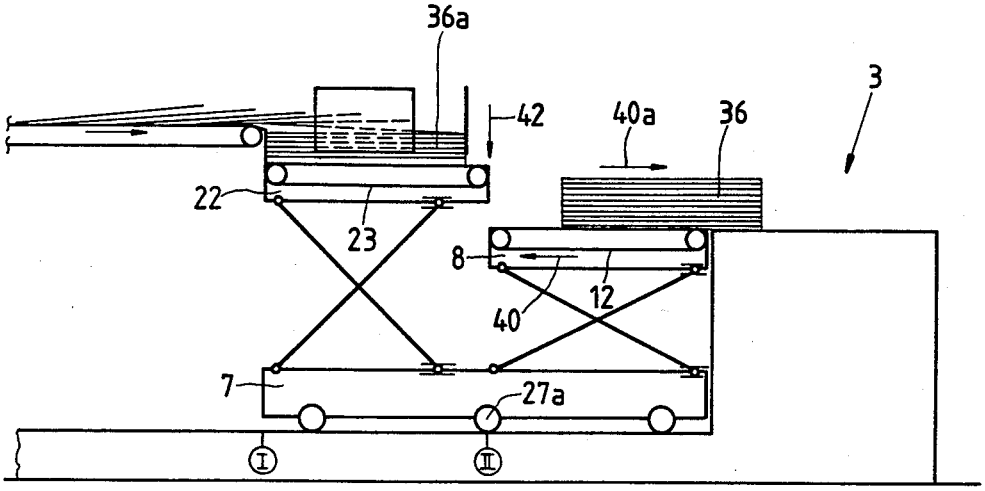
FIG. 5 shows the structure of FIG. 4 during transfer of the fully grown stack from the table onto the removing conveyor with and the platform in the process of accumulating a growing stack.

The height of the growing stack 36*a* on the conveyor 23 of the platform 22 continues to increase and the moving means 24 gradually or intermittently lowers the support of the platform 22 at the rate at which the height of the growing stack 36*a* on the conveyor 23 increases. The direction of downward movement of the platform 22 is indicated in FIG. 5 (note the arrow 42). At the same time, the conveyor 12 of the table 8 is set in motion in the direction of arrow 40 so that the upper reach of the conveyor 12 advances the fully grown stack 36 in the direction of arrow 40*a*. In other words, the fully grown stack 36 is transferred onto the raised rollers 32 of the stack removing unit 3. The raised rollers 32 rotate in response to engagement with the underside of the lowermost sheet 6 of the stack 36 so that the transfer of the stack 36 from the conveyor 12 onto the stack removing unit 3 takes place practically without any friction. When the stack 36 is fully transferred into or onto the removing unit 3, the motors 33 are actuated to lower the skeleton frame 34 so that the rollers 32 descend below the upper reaches of the endless belt conveyors 31. The motor or motors for the conveyors 31 are then set in motion to transport the fully grown stack 36 in a direction at right angles to the plane of FIG. 6.

Figure 6:
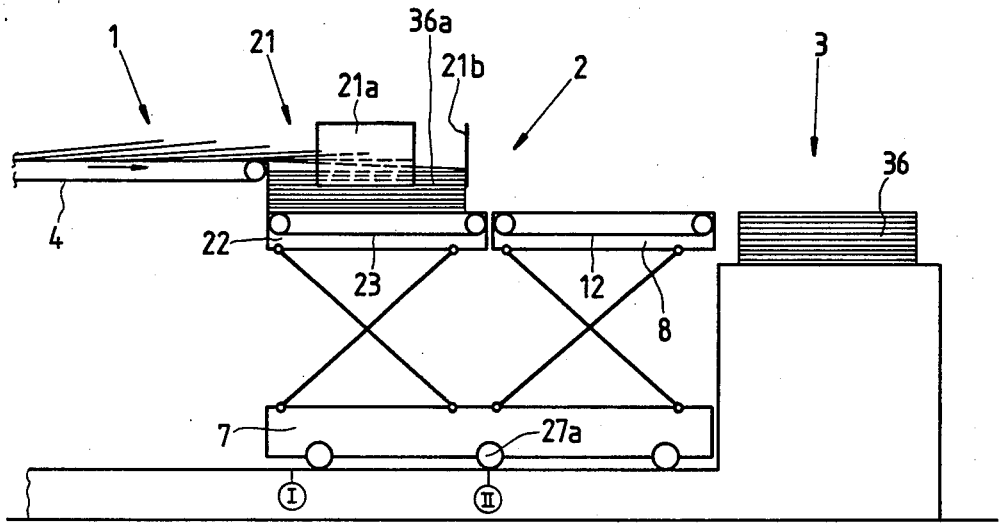
FIG. 6 shows the structure of FIG. 5 upon completed transfer of the fully grown stack from the table.

When the transfer of the stack 36 from the conveyor 12 into or onto the stack removing unit 3 is completed, the moving means 9 lifts the table 8 to the level of FIG. 6 in which the upper side of the upper reach of the conveyor 12 is flush with the upper side of the upper reach of the conveyor 23. From there on, the moving means 9 lowers the table 8 at the rate at which the height of the growing stack 36*a* on the conveyor 23 increases. At such time, the conveyors 12 and 23 are at a standstill.

Figure 7:
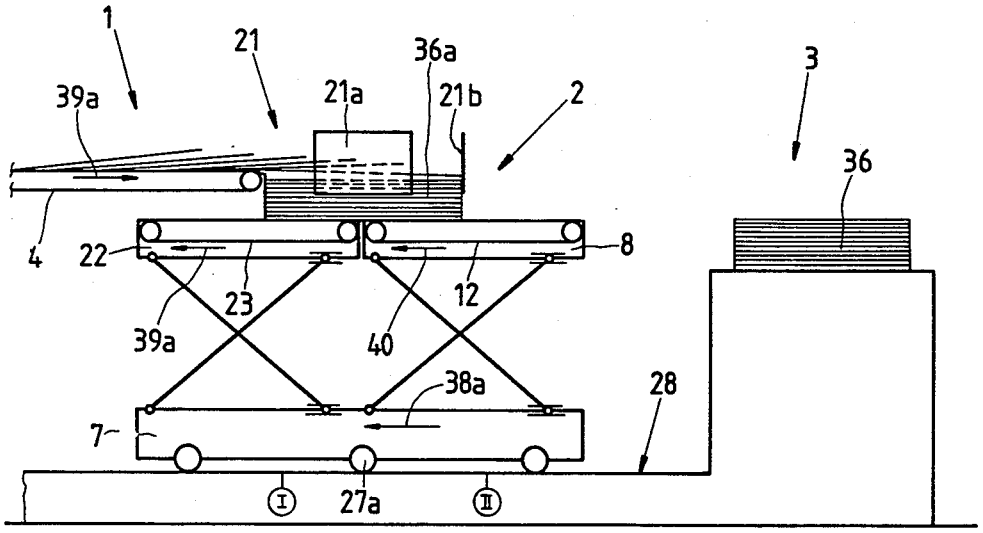
FIG. 7 shows the table and the platform during movement back to their first positions.

The next stage of operation is shown in FIG. 7. The motor for the conveyor 12 is set in operation to move the conveyor 12 in the direction of arrow 40 and the motor for the conveyor 23 is set in motion to drive this conveyor in the direction of arrow 39*a*. This results in a transfer of the growing stack 36*a* from the conveyor 23 onto the conveyor 12 while the carriage 7 moves from its position II back to its position I. The speed of the upper reaches of conveyors 12, 23 during such stage of veyors 12, 23 at the speed of movement of the carriage 7 in the direction of arrow 38*a* ensures that the transfer of the growing stack 36*a* from the conveyor 23 onto the conveyor 12 takes place without any friction, i.e., without any damage to the lowermost sheet or sheets of such stack. The moving means 9 and 24 continue to lower the table 8 and the platform 22 at the rate at which the height of the growing stack 36*a* increases during that stage of operation which is shown in FIG. 7.

Figure 8:
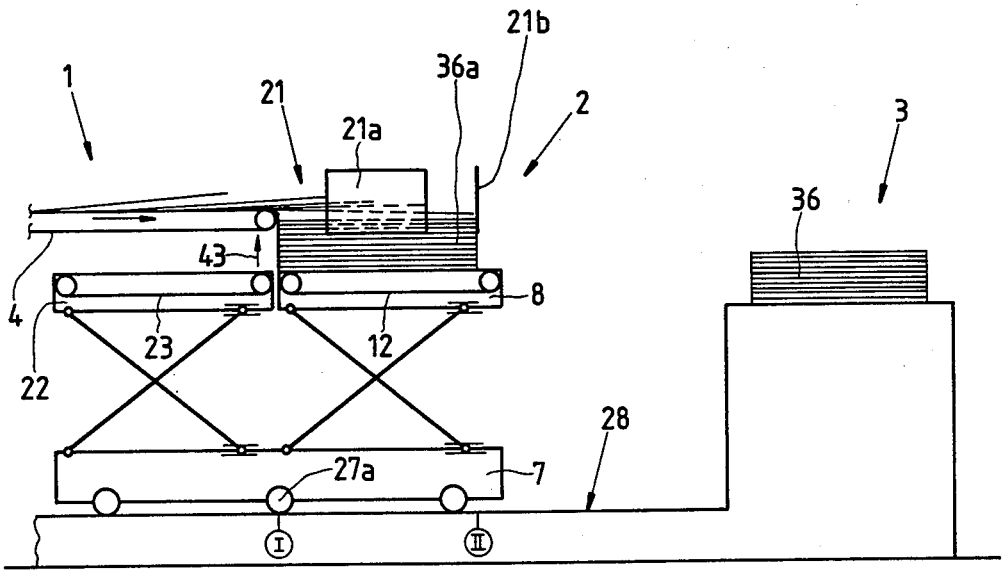
FIG. 8 shows the table and the platform back in their first positions with a stack in the process of growing on the conveyor of the table.

FIG. 8 shows the carriage 7 back in the position I. The table 8 has reassumed its first position and the platform 22 has reassumed its position of readiness beneath the conveyor 4. At such time, the moving means 24 is actuated to lift the platform 22 in the direction of arrow 43 so that the upper reach of the conveyor 23 is returned to the level which is shown in FIG. 3. The conveyors 12 and 23 are at a standstill.

From there on, the operation is the same as described above. Thus, the finger 19*a* penetrates into the space between the topmost sheet of the stack 36*a* and the next-following sheet 6 as soon as the growing stack is converted into a fully grown stack which contains a predetermined number of sheets. The fully grown stack is transferred onto or into the stack removing unit 3 in the aforedescribed manner while the platform 22 serves as a means for temporarily supporting the next growing stack.

Figure 9:
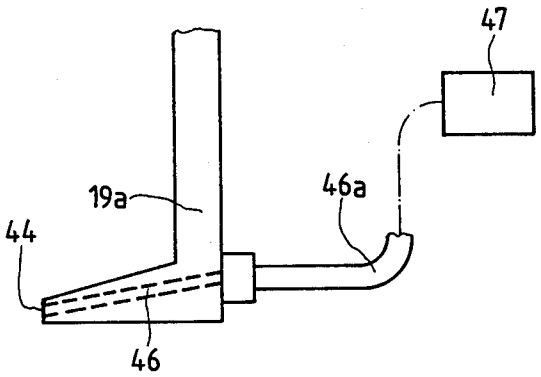
FIG. 9 is an enlarged schematic elevational view of the intercepting means.

FIG. 9 shows a presently preferred construction of the finger 19*a* of the means for intercepting selected sheets 6 at the gathering station 2 upon completed accumulation of a fully grown stack. The lower portion of the finger 19*a* resembles a wedge for convenient penetration between two neighboring stacks and is formed with a bore 46 the foremost end of which constitutes an orifice 44 for discharge of one or more streams of compressed air which is supplied from a source of compressed air 47 by a conduit 46*a*. The compressed air forms a cushion between the topmost sheet of the fully grown stack and the lowermost sheet of the growing stack to further reduce the likelihood of damage to such sheets during extraction of the fully grown stack from the gathering station 2. The finger 19*a* can be provided with a row of bores 46 and with an equal or even larger number of orifices 44 so as to discharge a relatively wide stream of compressed air which forms a cushion on top of the fully grown stack on the table 8. The arrangement is such that a valve (not specifically shown) opens automatically in response to a signal from a counter or from another device which monitors the number of sheets on the conveyor 12 of the table 8 or the height of the stack on the table and transmits a signal when the growing stack has been converted into a fully grown stack.

The improved apparatus can be used with advantage for accumulation of all kinds of sheets including readily flexible as well as relatively stiff and very stiff sheets. Furthermore, the apparatus can accumulate large, medium-sized or small sheets. It has been found that the improved apparatus can be used with advantage for accumulation of very large sheets which are thereupon subdivided into smaller sheets or which are accumulated into stationery products and other types of products each of which contains a predetermined number of large sheets. Heretofore known apparatus are not readily suitable for proper manipulation of large-format sheets because large sheets are likely to flex and require special undertakings in order to ensure that their integrity remains intact during accumulation into stacks as well as during subsequent manipulation of fully grown stacks.

An important advantage of the improved apparatus is that friction between the fully grown stack and the next-following (growing) stack is reduced close to or all the way to zero. The same applies for friction between the stacks and the adjacent portions of the apparatus such as the table 8 and the platform 22. The establishment of an air cushion between the topmost sheet of a fully grown stack and the lowermost sheet of a growing stack further reduces the likelihood of generation of friction which could affect the appearance and/or other characteristics of neighboring sheets. Still further, the aforementioned undertaking of causing the growing stack 36*a* to accumulate a certain number of sheets before the fully grown stack 36 is extracted from the gathering station 2 also contributes to a pronounced reduction of the likelihood of damage to the sheets at the top of a fully grown stack and/or at the bottom of the growing stack.

Another important advantage of the improved apparatus is that the accumulation of sheets into stacks takes place continuously, namely without any interruptions between completed assembly of a predetermined number of sheets into a fully grown stack and the return movement of the table 8 to the first position of FIG. 3. The transfer of fully grown stacks 36 from the gathering station 2 into or onto the stack removing unit 3 takes place without any distortion of stacks which is desirable and advantageous for further treatment of stacks in the machine or machines which receive stacks from the unit 3.

A further important advantage of the improved apparatus is its compactness. This is attributable, in part, to the feature that the table 8 and the platform 22 are mounted on a common carriage 7 and next to each other. As described above, the arrangement is such that the platform 22 automatically assumes its second position when the table 8 reaches the second position and that the platform 22 automatically reassumes its position of readiness when the table 8 reassumes its first position.

The mounting of the ram or rams 16*a* on the bracket or brackets 13 which are supported by the table 8 is preferred at this time because it contributes to simplicity and compactness of the apparatus.

It has been found that the output of the improved apparatus is much higher than the output of any heretofore known apparatus for accumulation and transfer of sheets to a removing unit, for example, for transfer into a packing machine.

The improved apparatus is susceptible of many additional changes without departing from the spirit of the invention. For example, the ram or rams 16*a* need not necessarily be mounted on the table 8 but can be mounted on the frame 17 in such a way that they are capable of sharing the movements of the table 8 from the first position toward the second position. This can be readily achieved by mounting the upper portions of the rams 16*a* in a suitable slide or carriage which is movable along the frame 17 in and counter to the direction indicated by arrow 38. The thus mounted ram or rams 16*a* can be provided with their own drive or they can be moved by the carriage 7 while the latter advances the table 8 from the position of FIG. 3 to the position of FIG. 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for forming and removing stacks of superimposed sheets, especially large sheets of paper and the like, comprising means for transporting a series of successive sheets along a predetermined path; a gathering table movable between a first position adjacent a portion of said path to accumulate successive sheets of the series into a growing stack and a second position for removal of the fully grown stack therefrom, said table comprising a support and a conveyor movably mounted on said support and arranged to gather oncoming sheets into a growing stack in the first position of said table; a platform movable between a first position of readiness and a second position adjacent said portion of said path to collect successive sheets of the series while said table is out of the first position thereof, said platform comprising a support and a conveyor movably mounted on the support and arranged to gather oncoming sheets into a growing stack in the second position of the platform; means for jointly moving said table and said platform so that the table assumes its first position while the platform assumes its first position and that the table assumes its second position while the platform assumes its second position; and means for operating said conveyors so as to transfer sheets from the platform onto the table during joint movement of the platform and table between said first and second positions.

2. The apparatus of claim 1, further comprising means for moving said table up and down, at least in the first position of said table.

3. The apparatus of claim 2, further comprising means for moving said platform up and down, at least in the second position of said platform.

4. The apparatus of claim 3, wherein the means for jointly moving said table and said platform comprises a common carriage for the table and the platform and means for moving the carriage from a first position, in which the table and the platform assume their first positions, to a second position in which the table and the platform assume their second positions, and back to the first position.

5. The apparatus of claim 3, wherein said means for moving the table and the platform up and down are operable to move the table up and down relative to the platform and vice versa.

6. The apparatus of claim 1, wherein at least one of said conveyors includes an endless belt conveyor.

7. The apparatus of claim 1, wherein said portion constitutes the discharge end of said path.

8. The apparatus of claim 1, further comprising means for biasing the sheets of a fully grown stack against the table, at least during a portion of movement of the table from the first to the second position thereof.

9. The apparatus of claim 8, wherein said biasing means and said table together constitute tongs for releasably clamping a fully grown stack between them.

10. The apparatus of claim 1, further comprising means for intercepting oncoming sheets in said portion of said path during movement of said table and said platform from the first to the second positions thereof.

11. The apparatus of claim 10, wherein said intercepting means includes a finger and means for moving the finger between the topmost sheet of a fully grown stack on said table in the first position of the table and the next-following sheet of the series of sheets in said path.

12. The apparatus of claim 11, wherein said finger has at least one orifice and further comprising means for admitting into said orifice a compressed gaseous fluid to establish a cushion of gaseous fluid between the topmost sheet of the fully grown stack on the table and the next-following sheet of the series of sheets.

13. The apparatus of claim 10, wherein said means for jointly moving said table and said platform includes means for moving said table from the first position thereof when said intercepting means has intercepted a preselected number of sheets.

14. The apparatus of claim 1, further comprising stack removing means, said table being adjacent said stack removing means in the second position thereof and the conveyor of said table being operative to transfer stacks from said table to said stack removing means in said second position of said table.

* * * * *